US007044285B2

(12) United States Patent
Takebayashi

(10) Patent No.: US 7,044,285 B2
(45) Date of Patent: May 16, 2006

(54) COIN DISCRIMINATING APPARATUS AND COIN DISCRIMINATING METHOD

(75) Inventor: Hidetoshi Takebayashi, 2-15, Kanou 6-chome, Higashiosaka-shi, Osaka (JP) 578-0901

(73) Assignee: Hidetoshi Takebayashi, Osaka (JP)

( * ) Notice: Subject to any disclaimer, the term of this patent is extended or adjusted under 35 U.S.C. 154(b) by 212 days.

(21) Appl. No.: 10/475,603

(22) PCT Filed: May 20, 2002

(86) PCT No.: PCT/JP02/04862

§ 371 (c)(1),
(2), (4) Date: Oct. 22, 2003

(87) PCT Pub. No.: WO03/032261

PCT Pub. Date: Apr. 17, 2003

(65) Prior Publication Data

US 2004/0129528 A1 Jul. 8, 2004

(30) Foreign Application Priority Data

Oct. 2, 2001 (JP) ..... 2001-306591

(51) Int. Cl.
*G07D 5/00* (2006.01)

(52) U.S. Cl. ..... 194/328; 382/136

(58) Field of Classification Search ..... 194/328, 194/302, 330; 382/136
See application file for complete search history.

(56) References Cited

U.S. PATENT DOCUMENTS

| | | | | |
|---|---|---|---|---|
| 5,494,147 | A * | 2/1996 | Takahashi et al. | 194/328 |
| 5,538,123 | A | 7/1996 | Tsuji | 194/303 |
| 5,887,697 | A | 3/1999 | Takahashi et al. | 194/317 |
| 6,328,150 | B1 * | 12/2001 | Hibari | 194/317 |
| 6,688,449 | B1 * | 2/2004 | Yamagishi | 194/328 |

* cited by examiner

*Primary Examiner*—Donald P. Walsh
*Assistant Examiner*—Mark J. Beauchaine
(74) *Attorney, Agent, or Firm*—Osha Liang LLP

(57) ABSTRACT

A circular image (A1) of a to-be-examined coin (A0) is picked up by a CCD sensor unit (11). The circular image (A1) of the to-be-examined coin (A0) is transformed into a rectangular image (B1) by a transformation processing means (142). On the other hand, a rectangular image (B) of a master coin (A) used as a criterion is prestored in a master-image memory (148). When the circular image (A1) of the to-be-examined coin (A0) is transformed into the rectangular image (B1) by the transformation processing means (142), the rectangular image (B1) is compared with the rectangular image (B) stored in the master-image memory (148) by a comparison means (144). If both of the rectangular images (B1, B) do not coincide substantially with each other, a part of the rectangular image (B1) of the to-be-examined coin is moved from an end thereof to an opposite end by an alignment means (143) so as to generate a new rectangular image (B2) through a shift conversion. If both of the rectangular images (B1, B) coincide with each other, it is judged that the to-be-examined coin (A1) is a genuine coin. If any one of the rectangular images of the to-be-examined coin does not coincide substantially with the rectangular image (B) of the master-image memory (148), it is finally judged that the to-be-examined coin (A0) is a spurious coin.

3 Claims, 11 Drawing Sheets

COIN DISCRIMINATING APPARATUS AND COIN DISCRIMINATING METHOD

TECHNICAL FIELD

The present invention mainly relates to a coin discriminating apparatus and a coin discriminating method for discriminating between genuine and spurious coins in game machines like a slot machine operated by the insertion of coins into a slot for games, in coin adjusting machines that adjust the accounts of coins, or in automatic vending machines that automatically dispense merchandise.

BACKGROUND ART

A game machine like a slot machine, a coin adjusting machine, an automatic vending machine, etc., have difficulty in discriminating between genuine and spurious coins under an image recognition technique based on a difference in the angle of a coin that results when the coin is inserted into the machine or based on the rotations of a coin made after the coin is inserted.

For example, a method shown in FIG. 1 can be mentioned as a method for discriminating between genuine and spurious coins by use of an image recognition technique. This method photographs a to-be-examined coin that has been inserted into a machine with a CCD camera or the like, then rotates a circular image (to-be-examined circular image) of the to-be-examined coin facing an unspecific direction (angle), thereby generates a new circular image, and compares a plurality of circular images generated in this way with a master circular image used as a criterion.

In greater detail, a to-be-examined circular image K1 facing the direction of (a) of FIG. 1 is first taken, to-be-examined circular images K2, K3, K4, K5, and K6 that are different in direction are then generated by rotating the circular image K1 in such a way as shown in (b) through (f), respectively, of FIG. 1, and these to-be-examined circular images K1, K2, K3, K4, K5, and K6 are compared with a master circular image. If any one (the circular image K6, for example) of the to-be-examined circular images coincides with the master circular image, the to-be-examined coin is regarded as a genuine coin. If none of the circular images K1, K2, K3, K4, K5, and K6 coincides with the master circular image, the to-be-examined coin is regarded as a spurious coin.

However, according to the conventional coin-discriminating method in which a comparison between the to-be-examined circular image and the master circular image is made by rotating the whole of the to-be-examined circular image, image rotation processing is heeded. Therefore, disadvantageously, much time is required for this processing, and a computer with a high processing performance, or the like, is needed because this image rotation processing must perform intricate calculations, such as a sine (i.e., sine function) calculation and a decimal point calculation, for a rotating coordinate transformation.

Additionally, in another coin discriminating method, a comparison between the to-be-examined circular image and the master circular image is made by correcting a rotational direction of the to-be-examined circular image facing an arbitrary direction. However, according to this discriminating method, processing likewise becomes complicated, and, disadvantageously, much processing time is required because the rotational direction of the circular image must be corrected.

Although an employee can discriminate between genuine and spurious coins visually or manually, much time and labor are required.

In the conventional coin discriminating methods mentioned above, since a comparison between the to-be-examined circular image and the master circular image is made by rotating the circular image of the to-be-examined coin or by correcting the rotational direction thereof, the methods are inferior in coin discriminating precision and have a tendency for discriminating. processing to become complicated in improving the precision of discrimination between genuine and spurious coins. Therefore, disadvantageously, more processing time is required proportionately therewith. In other words, if processing time becomes longer, discrimination between genuine and spurious coins will become difficult when a plurality of coins are inserted successively.

DISCLOSURE OF INVENTION

The present invention has been made in consideration of the aforementioned conventional disadvantages. It is therefore an object of the present invention to provide a coin discriminating apparatus and a coin discriminating method capable of discriminating between genuine and spurious coins accurately and swiftly through a simple processing procedure, and provide a readable medium recording a coin discriminating method and program.

The coin discriminating method according to the present invention for discriminating to-be-examined coins by making a comparison between an image of a to-be-examined coin taken by an image pickup device and an image of a prestored master coin used as a criterion is characterized by transforming a circular image of the to-be-examined coin taken by the image pickup device into a rectangular image, making a comparison between the rectangular image and a prestored rectangular image of the master coin used as a criterion, and determining whether the to-be-examined coin is genuine or spurious based on a result obtained by the comparison.

According to the coin discriminating method of the present invention, the circular image of the to-be-examined coin taken by the image pickup device is transformed into the rectangular image, the rectangular image is then compared with the prestored rectangular image, and, if both of the rectangular images coincide with each other, the to-be-examined coin is regarded as a genuine coin, and, if both of them do not coincide with, each other, the to-be-examined coin is regarded as a spurious coin or a counterfeit coin. According to the present invention, since the comparison therebetween is made by transforming the circular image of the coin into the rectangular image in this way, the circular image is not required to be rotated unlike the conventional method when the image of the to-be-examined coin is compared with the image of the master coin, and discrimination between genuine and spurious coins can be made swiftly through a simple processing procedure;

Additionally, in order to compare the rectangular image of the to-be-examined coin with the rectangular image of the master coin, the transformation into the rectangular image must be performed by cutting a part of the circular image of the to-be-examined coin, and long processing time is required to obtain a plurality of rectangular images by shifting the cutting position. However, in an aspect of the coin discriminating method of the present invention, a new rectangular image of the to-be-examined coin can be generated by moving a partial image occupying an edge of the rectangular image to an edge on the opposite side thereof, and thereby rectangular images having different cutting positions of a circular image can be easily generated The coin discriminating apparatus according to the present invention for determining whether a to-be-examined coin is genuine or spurious by making a comparison between an image of the to-be-examined coin taken by an image pickup device and a prestored image of a master coin used as a criterion includes a rectangular image generation means for transforming a circular image of a to-be-examined coin taken by the image pickup device into a rectangular image, a rectangular-image storage means for prestoring a rectangular image of a master coin used as a criterion, and a comparison means for making a comparison between a rectangular image obtained by the rectangular image generation means and a rectangular image stored in the rectangular-image storage means, and determines whether the to-be-examined coin is genuine or spurious based on a comparison result obtained by the comparison means.

According to the coin discriminating apparatus of the present invention, the circular image of the to-be-examined coin taken by the image pickup device is transformed into the rectangular image by the rectangular-image generation means, the rectangular image is then compared with the rectangular image stored in the rectangular-image storage means by the comparison means, and, if both of the rectangular images coincide with each other, the to-be-examined coin is regarded as a genuine coin, and, if both of them do not coincide with each other, the to-be-examined coin is regarded as a spurious coin or a counterfeit coin. According to the present invention, since the comparison there between is made by transforming the circular image of the coin into the rectangular image in this way, the circular image is not required to be rotated unlike the conventional method when the image of the to-be-examined coin is compared with the image of the master coin, and discrimination between genuine and spurious coins can be made swiftly through a simple processing procedure with a simple structure.

For example, if a method according to which an image situated on a line connecting the center point of a circular image of a coin to a point on the circumference of the circular image is rearranged to be situated on a line parallel to one side of a rectangular image area is employed in order to transform a circular image of a coin like the to-be-examined coin or the master coin into a rectangular image, the circular image can be easily transformed into the rectangular image by moving the line of the rectangular image along a side perpendicular to the aforementioned side while moving the point on the circumference of the circular image Additionally, in order to compare the rectangular image generated by the rectangular-image generation means with the image stored in the rectangular-image storage means, the transformation into the rectangular image must be performed by cutting a part of the circular image, and long processing time is required to obtain a plurality of rectangular images by shifting the cutting position. However, in an aspect of the coin discriminating apparatus of the present invention, rectangular images having different cutting positions of a circular image can be easily generated by adjusting the position of the rectangular image because the rectangular-image generation means has a function to adjust the position of the rectangular image.

In greater detail, the function to adjust the position of the rectangular image is performed by moving partial images (for example, images having a width of one or several pixels) at an edge of the rectangular image, for example, to an opposite edge thereof, by joining them together, and by generating a new rectangular image.

Various methods can be mentioned as the method for making a comparison between a rectangular image generated by the rectangular-image generation means and a rectangular image stored in the rectangular-image storage means, and, according to a first method among the methods, a determination is made as to whether both of the rectangular images are almost identical to each other. In greater detail, a concentration (brightness or luminosity) of each pixel may be compared between a rectangular image, transformed by the rectangular-image, generation means and a rectangular image stored in the rectangular-image storage means. Thereby, discrimination like visual perception can be made.

Alternatively, the rectangular image transformed by the rectangular-image generation means and the rectangular image stored in the rectangular-image storage means can be easily compared and discriminated by judging whether both the rectangular images are almost identical to each other based on a difference image between the rectangular images. The positioning task of the rectangular-image generation means can be lessened if a plurality of rectangular images taken from different angles with respect to the master coin used as a criterion are stored in the rectangular-image storage means when compared.

Alternatively, a method according to which histogram data regarding the rectangular image generated by the rectangular-image generation means are compared with histogram data regarding the rectangular image stored in the rectangular-image storage means may be employed as the method for making a comparison between the rectangular image generated by the rectangular-image generation means and the rectangular image stored in the rectangular image storage means. According to this method, there is no need to adjust the position of the rectangular image, and all that is needed is to make a comparison between histogram data, not between the images.

Alternatively, the coin discriminating apparatus of the present invention may include a rectangular-image generation means for transforming a circular image of a to-be-examined coin taken by the image pickup device into a rectangular image, a rectangular-image-storage means for prestoring histogram data regarding an image of a master coin used as a criterion, and a comparison means for making a comparison between histogram data regarding a rectangular image obtained by the rectangular-image generation means and histogram data stored in the rectangular-image storage means, and may determine whether the to-be-examined coin is genuine or spurious based on a comparison result obtained by the comparison means. This comparison using the histogram makes it possible to perform processing more easily and in a shorter time than the comparison using only the images.

If a comparison between the rectangular image of the to-be-examined coin or histogram data there regarding and the rectangular image of the master coin or histogram data there regarding is made only in an image area having high transformation accuracy from a circular image to a rectangular image, a processing data amount can be reduced without decreasing comparison accuracy, and processing speed can be improved. Additionally, use of a low gradation histogram makes it possible to further increase processing speed when the histogram is used.

In another aspect of the present invention, processing by the rectangular-image generation means, processing by the rectangular-image storage means, and processing by the comparison means may be applied sequentially and in parallel to coins that have been inserted continuously or intermittently. According to this aspect, processing speed as a whole can be improved even if coins are inserted continuously or intermittently, and the coins inserted continuously or intermittently can be accurately regarded as genuine or spurious ones.

In still another aspect of the present invention, since a coin passage detecting means is provided for detecting the passage of a to-be-examined coin, an image of the coin can be taken synchronously with the passage timing of the coin. Additionally, a clear circular image can be obtained by illuminating the coin with light if a light emitter is provided for illuminating the coin with light.

A readable medium that records a coin discriminating program according to the present invention orders a processor to execute processing for transforming a circular image of the to-be-examined coin into a rectangular image, processing for generating a new rectangular image of the to-be-examined coin by moving a partial image situated at an edge of the rectangular image to an edge on the opposite side thereof, and processing for determining whether the to-be-examined coin is genuine or spurious by comparing the rectangular image of the to be examined coin with the prestored rectangular image of the master coin used as a criterion. Herein, the processor is a device, such as a personal computer, a CPU, or an MPU, that can execute the processing according to a program. A hard disk, a ROM, or an EEPROM can be mentioned as a typical example of the medium, including a floppy disk, an MO, a CD, a ZIP, a DV, etc. According to the medium, the coin discriminating method of the present invention can be executed by incorporating this into the processor.

BRIEF DESCRIPTION OF DRAWINGS (a) through (f) of FIG. 1 are views of circular images of a coin for explaining the processing of a conventional coin discriminating method.

FIG. 2. is a system configuration view of a coin discriminating apparatus according to a first embodiment of the present invention.

FIG. 3 is a block diagram that shows an electric structure of the coin discriminating apparatus according to the first embodiment of the present invention.

(a) and (b) of FIG. 4 are explanatory drawings for explaining the principle to apply transformation processing from a circular image to a rectangular image by a transformation processing means shown in FIG. 3

FIG. 5 is a timing chart that shows the processing of the coin discriminating apparatus according to the first embodiment of the present invention.

(a) through (f) of FIG. 6 are views that show a situation in which rectangular images of the coin are being aligned in the first embodiment.

(a) through (g) of FIG. 7 are views for explaining a method for shifting the rectangular image of a to-be-examined coin and a method for obtaining a difference image by making a comparison between a shifted rectangular image and a master image in the first embodiment.

BEST MODE FOR CARRYING OUT THE INVENTION

A detailed description will hereinafter be given of the best mode for carrying out the present invention with reference to the attached drawings.

FIRST EMBODIMENT

Figure 2:
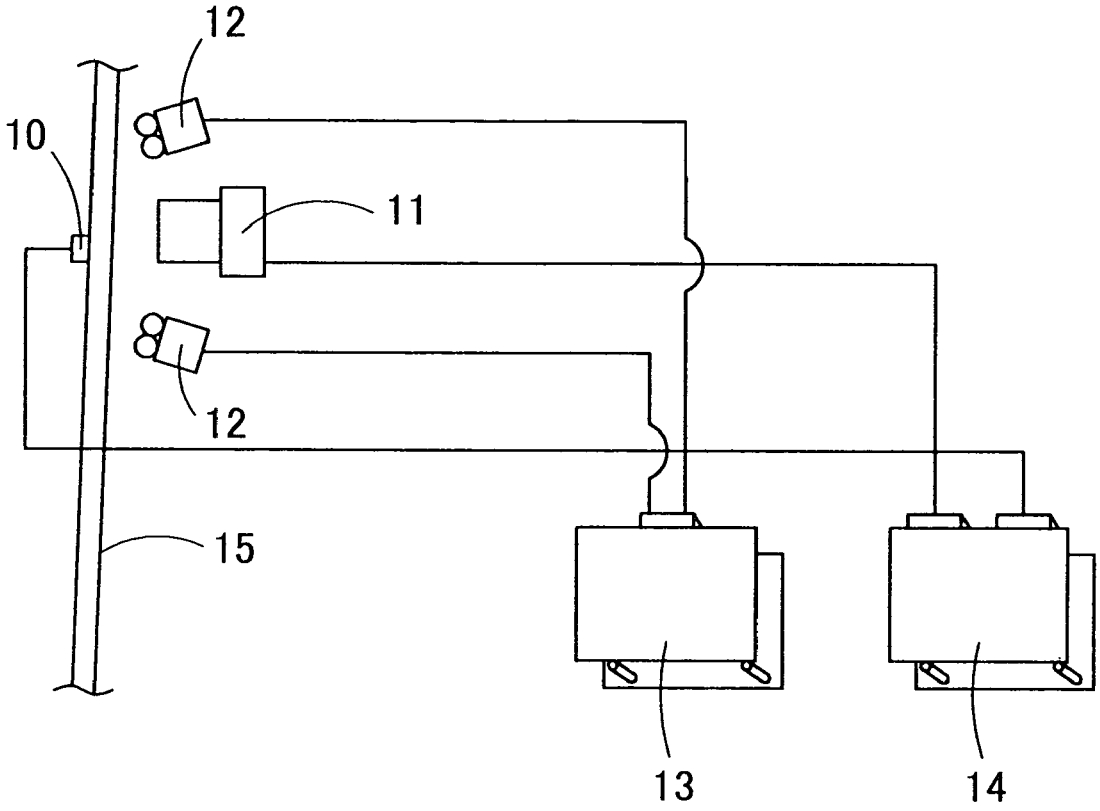

FIG. 2 is a system configuration view of a coin discriminating apparatus according to a first embodiment of the present invention. The coin discriminating apparatus is made up of a comparison processing unit 14 that performs a processing operation to make a comparison between coin images, an illumination power unit 13 that supplies operating voltage to a light emitter 12, a sensor bracket 10 comprising an optical fiber, a light emitting element (LED) and a light-receiving element (photodiode, for example) disposed at a predetermined position in relation to a coin passage path 15 so that the passage of a coin can be detected, the light emitter 12 that illuminates a coin passing through the coin passage path 15 with light, and a CCD sensor unit 11 that picks up an image of the coin passing through the coin passage path 15. An image pickup device is made up of the CCD sensor unit 11 and the light emitter 12. The light emitter 12 is made up of the light emitting diode (LED), a strobe light, a lamp, etc.

Figure 3:
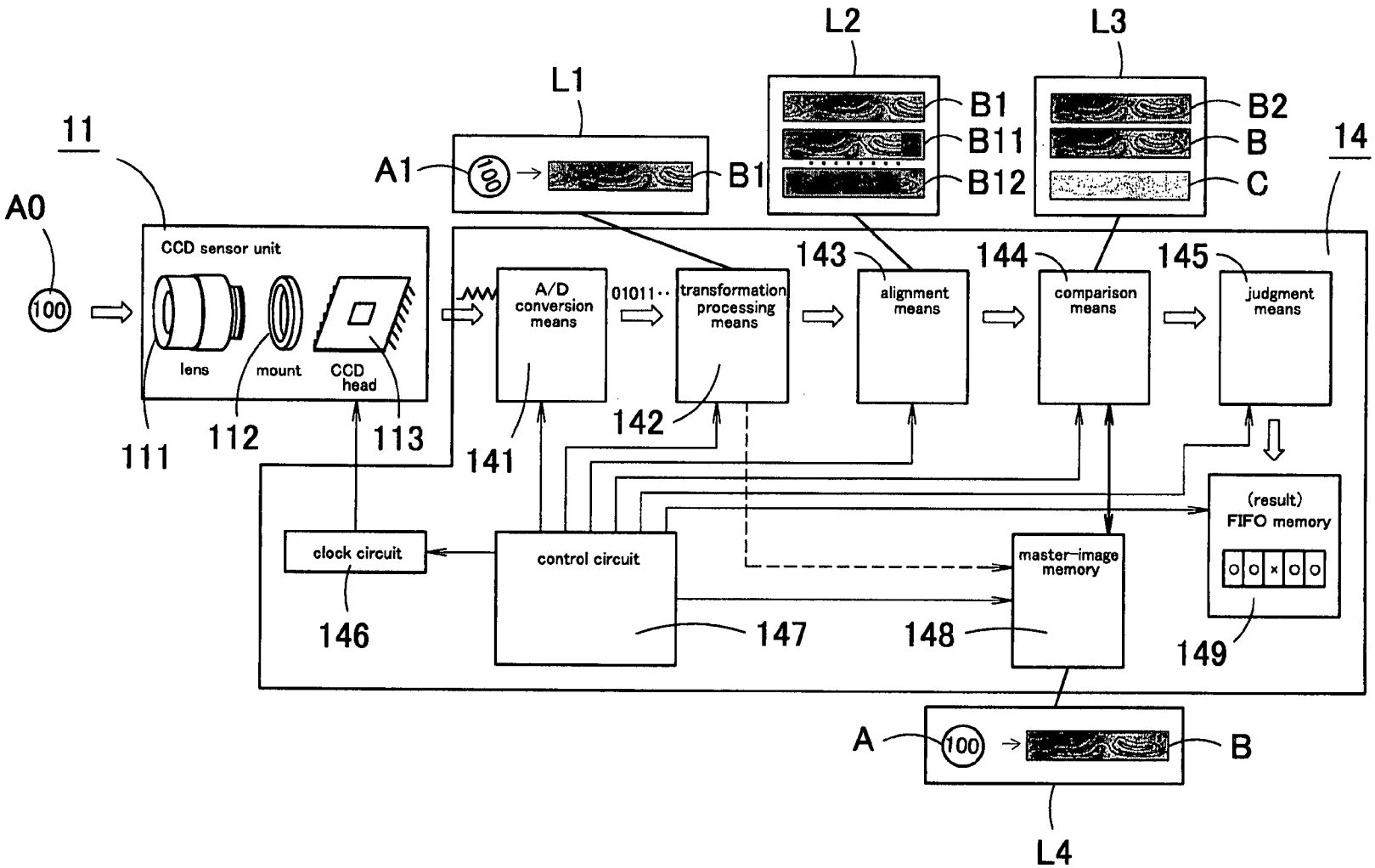

FIG. 3 is a block diagram that shows the electric structure of the CCD sensor unit 11 and the comparison processing unit 14 that constitute the coin discriminating apparatus in the first embodiment. The CCD sensor unit 11 is made up of a CCD head 113 that receives imaging light from a coin A0 illuminated with light of the emitter 12 and converts it into an image signal, a lens 111 used to form an image of the coin A0 to be examined on the CCD head 113, and a mount 112 to which the lens 111 is detachably attached. Since the lens 111 can be attached and detached to and from the mount 112, the lens 111 can be replaced with another lens having a suitable magnification or f value in accordance with the distance between the CCD head 113 and the coin passage path 15 or in accordance with the enlargement ratio of a coin image.

The comparison processing unit 14 includes an A/D conversion means 141 for converting an analog signal that indicates a circular image of the coin A0 output by the CCD sensor unit 11 into a digital signal (hereinafter referred to as "circular image signal") that indicates the circular image of the coin A0, a transformation processing means 142 for transforming the circular image signal output from the A/D conversion means 141 into a digital signal (hereinafter referred to as "rectangle-image signal") of a rectangular image, an alignment means 143 for aligning the rectangular image signal output from the transformation processing means 142 on an image in order to make a comparison with a digital rectangular image signal (hereinafter referred to as "master image signal") of a master coin "A" used as a criterion, a comparison means 144 for comparing the aligned rectangle-image signal with a master-image signal prestored in a master-image memory (i.e., master-image storage means) 148, a judgment means 145 for judging this comparison result, and a memory (for example, FIFO memory) 149 for storing this judgment result.

Figure 1:
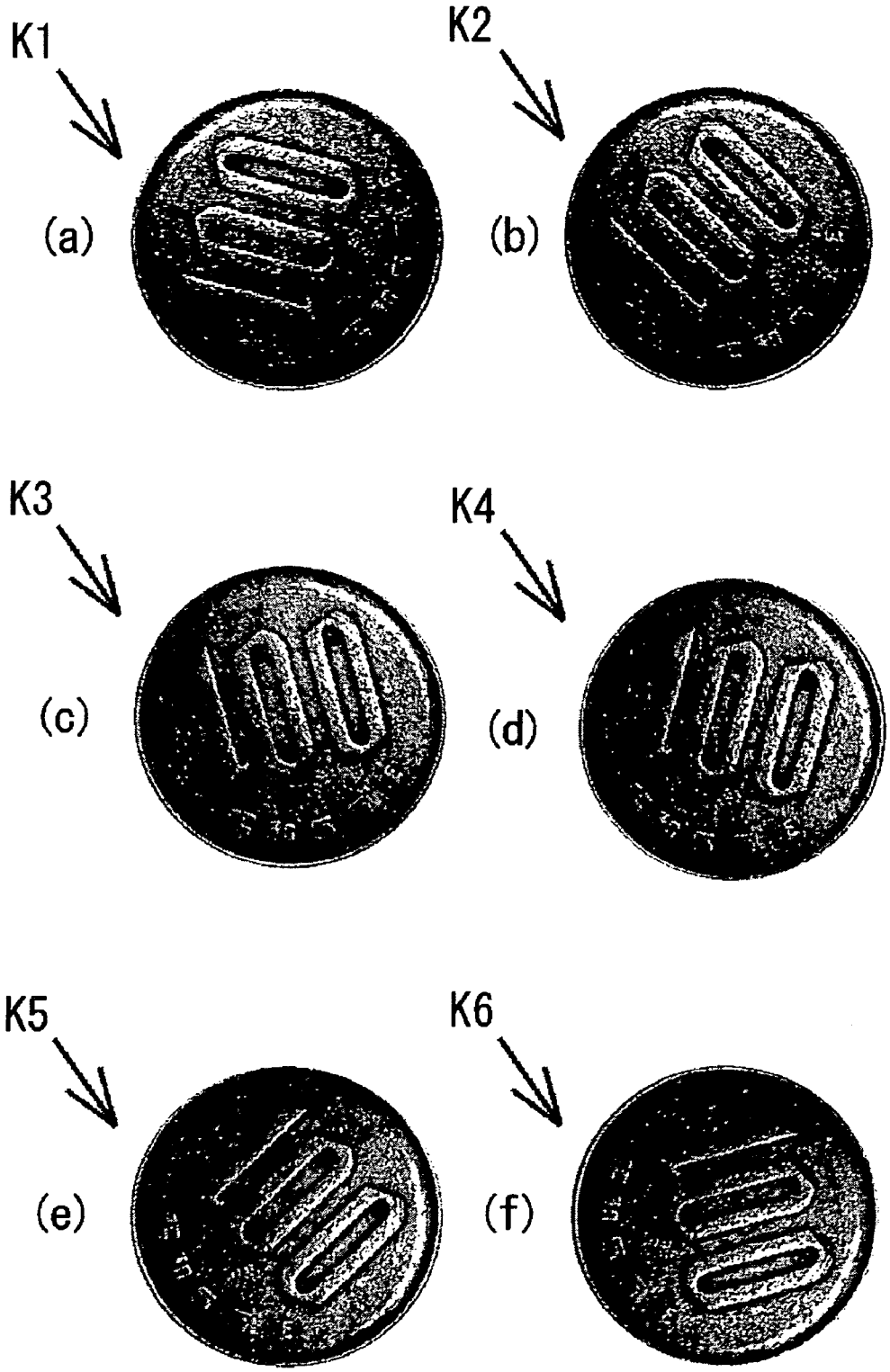

In a frame L1 of FIG. 3, A1 designates a circular image of a coin A0 to be examined (for example, the circular image of the coin shown in FIG. 1), and B1 designates a rectangular image obtained by transforming the circular image A1 (processing of FIG. 4 described later) by the transformation, processing means 142 into a developed rectangle. A frame L2 of FIG. 3 shows a situation in which the rectangular image is being aligned by the alignment means 143 (see FIG. 6 and (a) through (c) of FIG. 7 described later). In a frame L4, "A" designates a circular image of the master coin used as a criterion, and B designates a rectangular image (hereinafter referred to as "master image") of the master coin stored in the master-image memory, 148 by allowing the transformation processing means 142 to. pre-transform the master circular image "A" The master-image memory 148 may store a plurality of master images B having different edge positions obtained from master circular images of a master coin that have been photographed from different directions. In a frame L3, B2 designates a to be examined rectangular image that has been aligned, and B designates a master image stored in the master-image memory 148. C designates an image (difference image) that is a result obtained by making a comparison between both images by the comparison means 144 (processing of (d) through (g) of FIG. 7 described later). In the frame L3, an image C is pale because the rectangular image B2 of the to be examined coin A0 and the master image B are almost identical to each other. This means that, if an accurate judgment result is formed regarding the to be examined coin A0, an image concerning the judgment result becomes pale.

Figure 4:
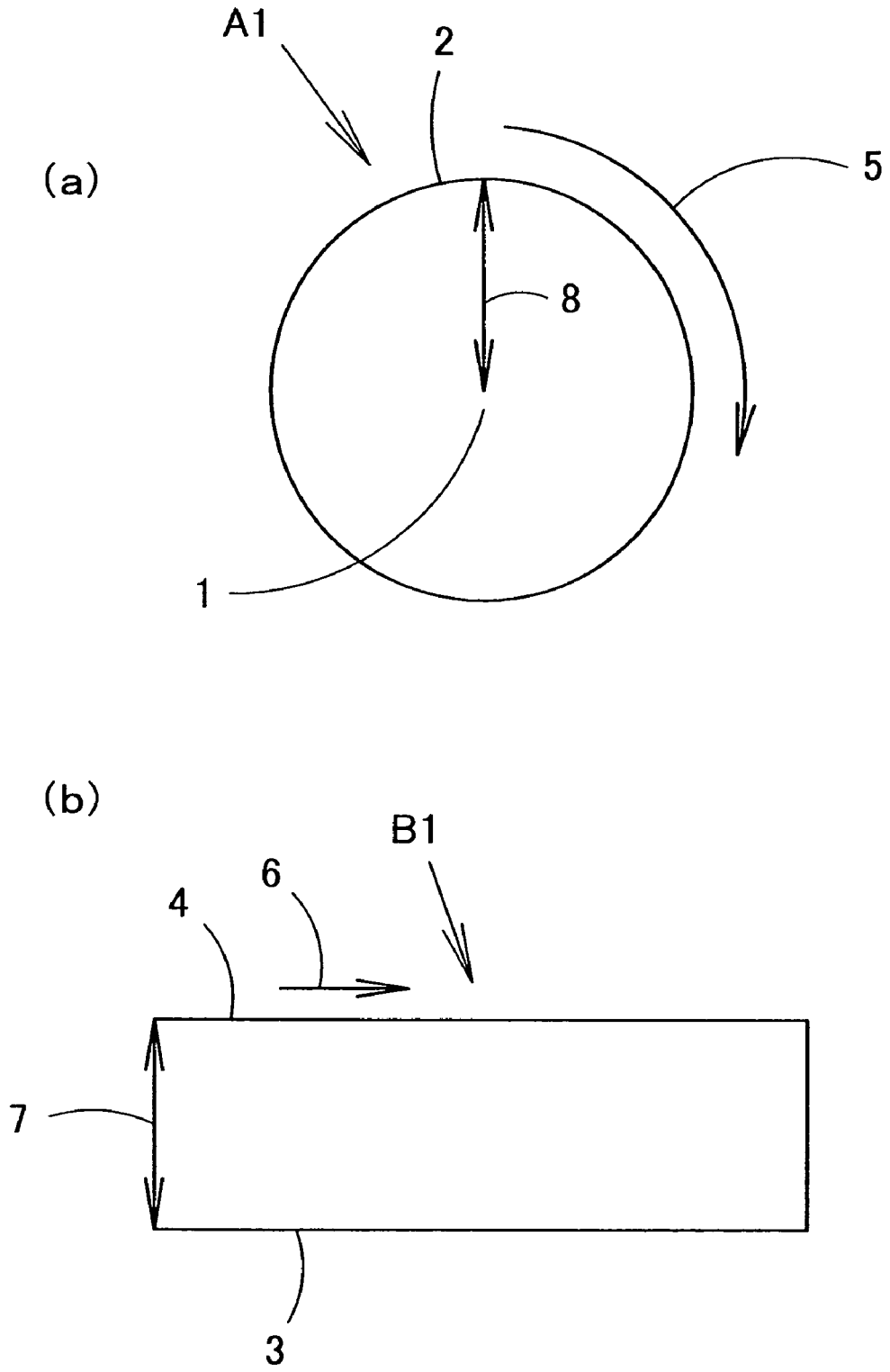

The comparison processing unit 14 includes a control circuit 147 that controls the A/D conversion means 141, the transformation processing means 142, the alignment means 143, the comparison means 144, the judgment means 145, the master-image memory 148, and the memory (for example, FIFO memory) 149, and a clock circuit 146 that is controlled by the control circuit 147 and gives a clock signal to the CCD head FIG. 4 explains the principle of the transformation processing from the circular image A1 of the coin shown in (a) of FIG. 4 to the rectangular image B1 thereof shown in (b) of FIG. 4 by the transformation processing means 142 (i.e., processing of the frame L1 of FIG. 3). The processing of the transformation processing means 142 will be described. First, the center position (center point) 1 of the circular image A1 is calculated from the coordinates of three points existing on the circumference 2 of the circular image A1. Alternatively, on the assumption that the circular image A1 is a round object having uniform mass, the center of gravity position of the round object may be calculated, and this center of 7 gravity position may be the geometrical center position 1 of the circular image A1. Alternatively, the intersection of a perpendicular line passing through the widthwise center of the circular image A1 and a horizontal line passing through the heightwise center of the circular image A1 may be assumed as the center position 1 of the circular image A1. Processing is perform to transform (transfer) an image on a line 8 extending from the center position 1 of the circular image A1 obtained by this calculation toward an arbitrary position (movable point) on the circumference 2 of the circular image A1 into an image on a line 7 extending from a side 3 toward a side 4 on the area of the rectangular image.

That is, the line 8 on the circular image A1 is divided into several equal parts, average brightness is then calculated by use of pixels in areas resulting from the division along the line 8 or pixels there around, and the average brightness of each area on the line 8 is allocated onto the line 7 in the area of the rectangular image (in the direction of the ordinate axis). Thereafter, the position on the circumference 2 is moved, and the same processing is performed. In detail, the point on the circumference 2 is moved, for example, in the direction of an arrow 5 with equal intervals, and the aforementioned processing is repeated. Thereby, the area of the rectangular image is continuously filled with converted pixels along the direction of an arrow 6, and, when 360-degree image transformation processing is completed, a rectangular image B1, in which the number of pixels along the line 7 in the direction of the ordinate axis is equal to the number of divisions of the line 8 and in which the number of pixels in the direction of the abscissa axis is equal to the number of times of the movement of the point on the circumference 2, is obtained in the rectangle-image area.

The rectangular image B1 that has been converted wherein the pixel array in the direction indicated by the line 7 substantially corresponds to the pixel array on the line 8 of the circular image A1, and the pixel array in the direction of the side 4 substantially corresponds to the pixel array in the direction of the circumference 2 of the circular image A1. The pixel converting position is moved in the direction of the circumference 2 in the aforementioned example, but, without being limited to this, the circular image may be rotated while fixing the pixel converting position. That is, the same rectangular image B1 can be obtained even if the pixel converting position (line 8) and the circular image A1 are relatively moved.

Figure 5:
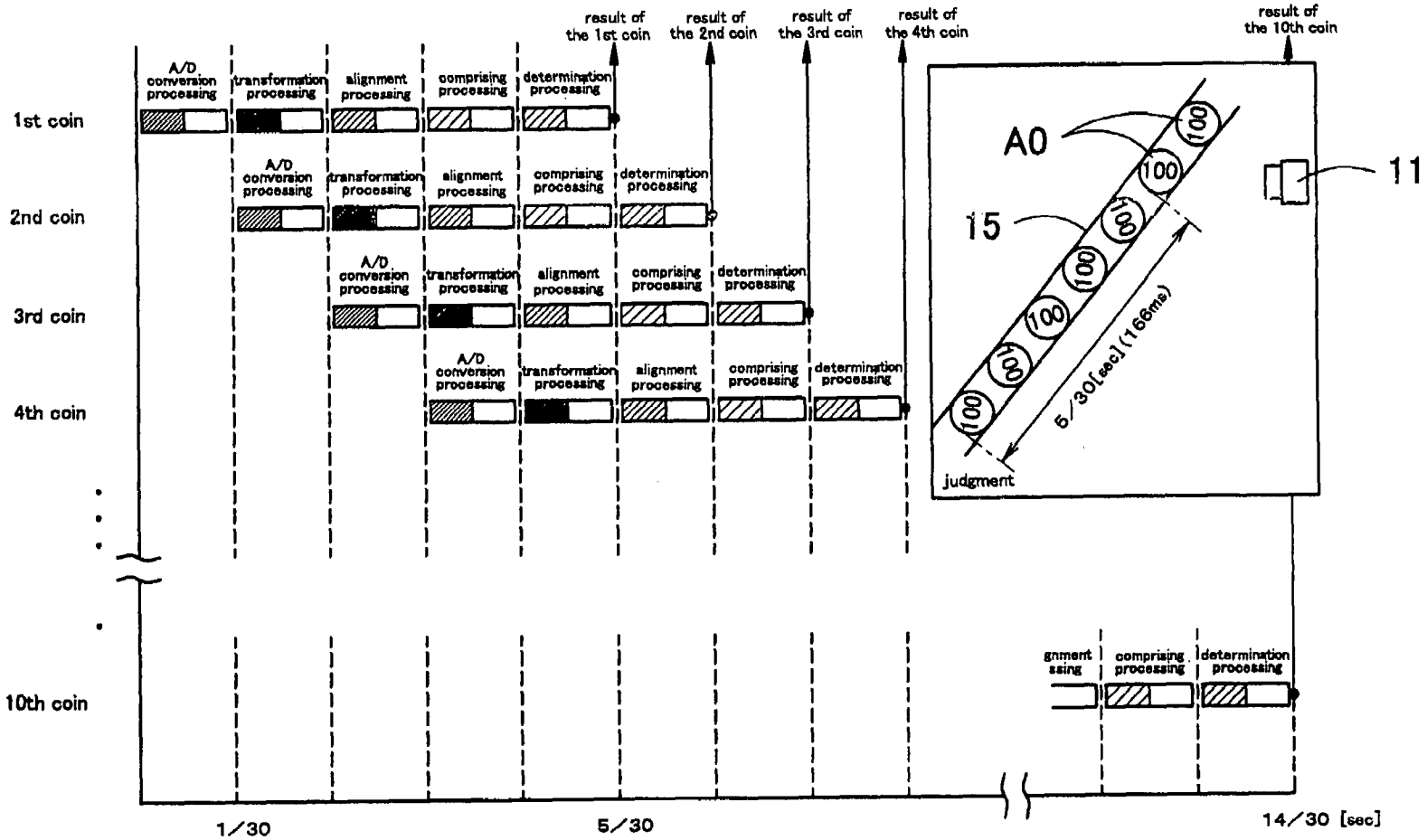

FIG. 5 is a timing chart that shows processing in the coin discriminating apparatus according to the first embodiment. The A/D conversion processing, the transformation processing, the alignment processing, the comparison processing, and the determination processing, which are a series of processing procedures followed until the circular image A1 of the to be examined coin A0 picked up by the image pickup device is transformed into the rectangular image B1 as shown in FIG. 5, the rectangular image B1 is then aligned while being shifted, the rectangular image is then compared with the rectangular image B of the master coin, and a determination, is made as to whether the to be examined coin A0 is genuine or spurious, are performed sequentially and in parallel according to each insertion timing when a plurality of to be examined coins A0 are continuously inserted. FIG. 5. shows timing according to each coin image processed in parallel while photographing first to tenth coins A0 passing through the coin passage path 15 by the CCD sensor unit 11. For example, when the rectangular image of the first coin A0 is being compared, the other coins are processed sequentially and in parallel such that the rectangular image of the second coin A0 is subjected to the alignment processing, the rectangular image of the third coin A0 is subjected to the transformation processing, and the circular image of the fourth coin A0 is subjected to the A/D conversion.

Thus, since a series of processing procedures are sequentially and continuously performed according to each insertion timing when a plurality of to be examined coins A0 are continuously inserted, i.e., since a series of processing procedures are applied in parallel to each coin A0 even if the number of to-be-examined coins A0 is plural, the stand-by time of each processing process can be shortened, and the coin discriminating processing can be, as a whole, performed efficiently, and therefore the processing can be completed a high speed.

Figure 6:
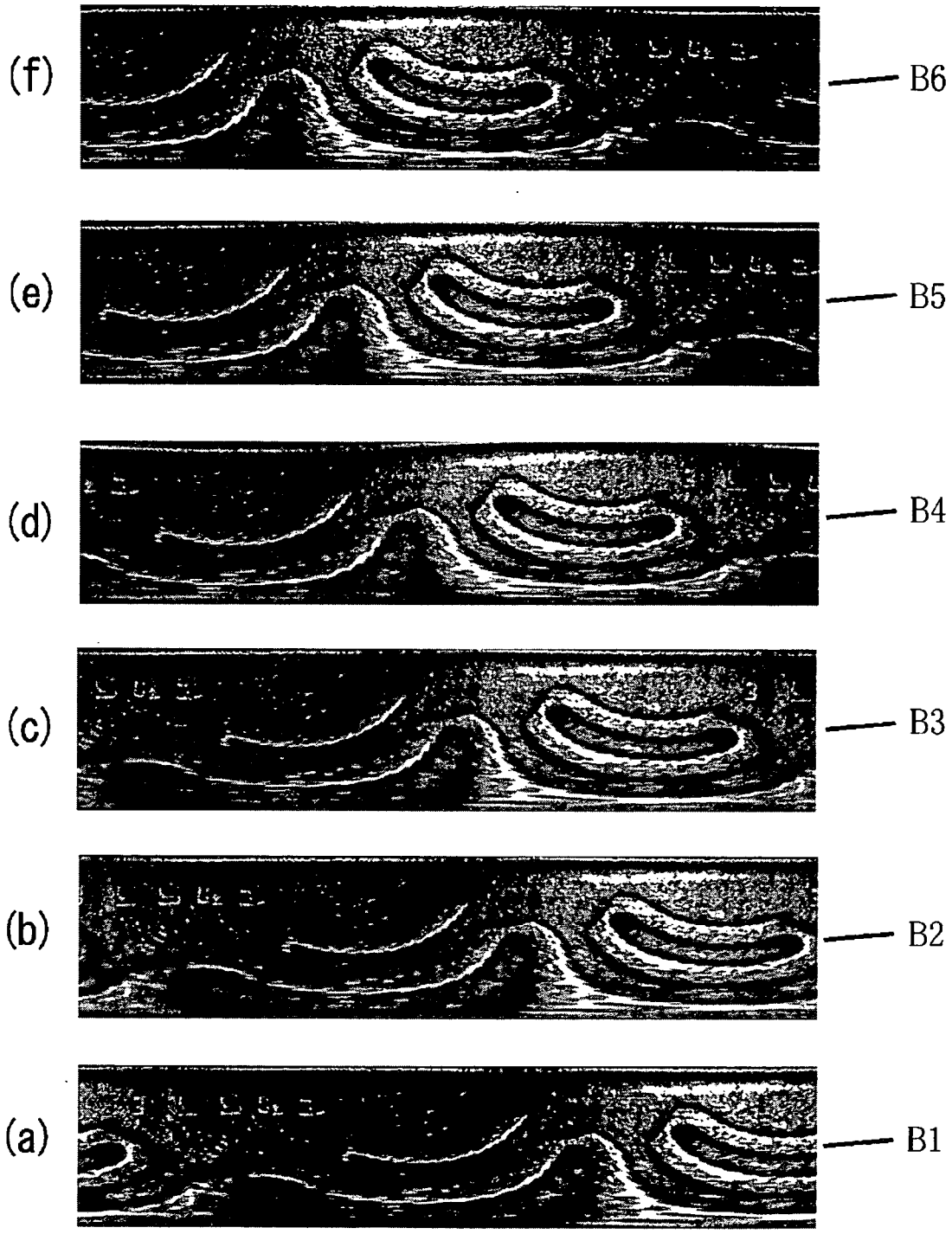
Figure 7:
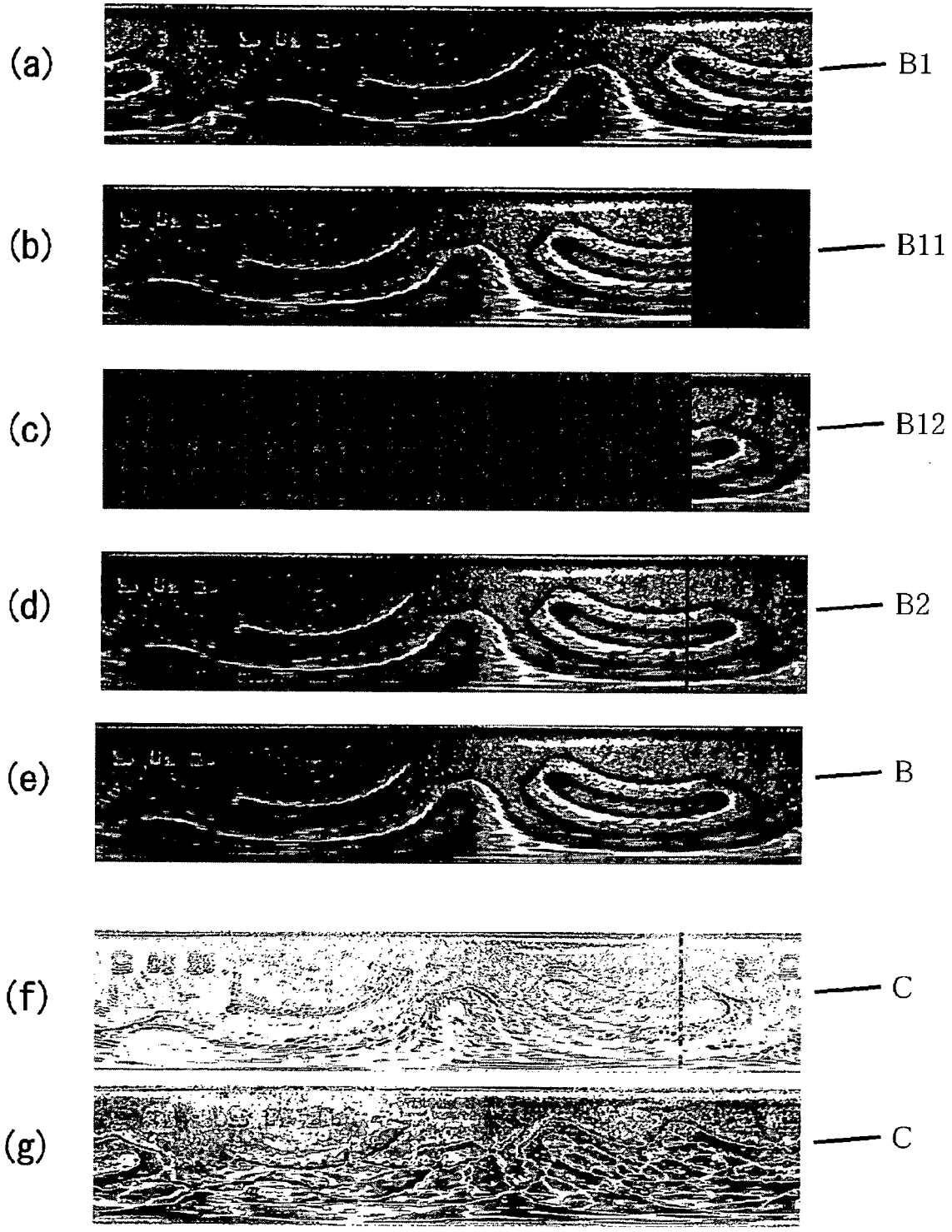

(a) of FIG. 6 shows a rectangular image B1 obtained by rightward rotating the movable point on the circumference 2 of the circular image A1 of the to-be-examined coin A0 and applying transformation processing as described with reference to FIG. 4, and (b) through (f) of FIG. 6 show a situation in which the rectangular image B1 is being shifted (processing of the frame L2 of FIG. 3). FIG. 7 explain same method for shifting the rectangular image of the to-be-examined coin A0 and a method for making a comparison between a rectangular image that has been shifted and a rectangular image B of the master coin (processing of the frames L2 and L3 of FIG. 3). In FIG. 7, (a) is a rectangular image, e.g., the image B1, of the to-be-examined coin, and (b) is a rectangular image B11 obtained by leftward shifting the rectangular image B1 of (a) by one pixel. (c) of FIG.7 is an image B12 obtained by moving one pixel that has overflowed the area of the rectangular image because of the leftward shift of (b) of FIG. 7 to the right end of the area of the rectangular image (in the figure, the amount of one pixel is shown with some exaggeration). (d) of FIG. 7 is a shift image formed by synthesizing the rectangular image B11 of (b) of FIG. 7 and the image B12 of (c) of FIG. 7, i.e., is the rectangular image B2, and (e) of FIG. 7 is the master image B. (f) and (g) of FIG. 7 each show a difference image C between a rectangular image to be examined and the master image B shown in (e) of FIG. 7, (f) of FIG. 7 being a rectangular image (difference image C) obtained when the difference of a comparison result is small like the rectangular image B2 of (d) of FIG. 7, (g) of FIG. 7 being a rectangle-image (difference image C) obtained when the difference of a comparison result is large As can be understood from these comparison results, if the to-be-examined rectangular image and the master image substantially coincide with each other and if a comparison result between the to-be-examined rectangular image and the master image has a small difference, the difference image will have monotonous gradations. As the comparison result therebetween becomes larger, light and shade of the difference image becomes clearer. Therefore, an automatic determination can be made as to whether the to-be-examined coin A0 is genuine or spurious by digitizing unevenness in the light and shade of the difference image and comparing this with a predetermined threshold.

Next, the operation of the first embodiment will be described with reference to FIG. 2 through FIG. 7. For example, when the first coin A0 is inserted into a coin slot of a slot machine, the coin A0 passes through the coin passage path 15. When the coin A0 passes an image pickup point there, the sensor bracket 10 detects the passage of the coin A0, and gives a coin passage signal synchronizing with the passing speed of the coin A0 to the comparison processing unit 14. In response to this, the comparison processing unit 14 sends a random trigger shutter command synchronizing with the coin passage signal from the sensor bracket 10 to the CCD sensor unit 11. Thereby, the CCD unit 11 photographs the coin A0 illuminated with light of the light emitter 12, and the comparison processing unit 14 takes an image of the photographed image while synchronizing with the coin passing speed. When the image is taken in, the process proceeds to an image analysis mode, and an analysis program is executed in the comparison processing unit 14. The analysis program has the functions of the A/D conversion means 141, the transformation processing means 142, the alignment means 143, the comparison means 144, and the judgment means 145.

The processing of the analysis program will be described here. An analog circular-image signal output from the CCD sensor unit 11 is input to the A/D conversion means 141, is then converted into a digital circular-image signal, and is output. The digital circular-image signal output from the A/D conversion means 141 is input to the transformation processing means 142, is then transformed into a rectangle-image signal, and is aligned by the alignment means 143 so that a comparison with a master-image signal can be made. The rectangular-image signal that has been aligned is compared with a master-image signal read from the master-image memory 148 by the comparison means 144, and a comparison result obtained by this comparison is input to the judgment means 145.

Based on the input comparison result, the judgment means 145 judges whether the inserted coin A0 is genuine or spurious, and a judgment result there regarding is stored in the memory 149. If the to-be-examined coin A0 is regarded as a spurious coin from the discrimination result, the rectangular image of the to-be-examined coin A0 is shifted by the alignment means 143 only by one pixel, and a comparison is again made between the rectangular image and the master image B. As a result, if any one of the rectangular images coincides with the master image B, the to-be-examined coin A0 is regarded as a genuine coin, and, if none of the rectangular images coincides with the master image B, the final decision that the to-be-examined coin A0 is a spurious coin is formed. Thus, a determination is made as to whether the coins A0 that have been successively inserted are genuine or spurious through the same processing procedure.

Figure 8:
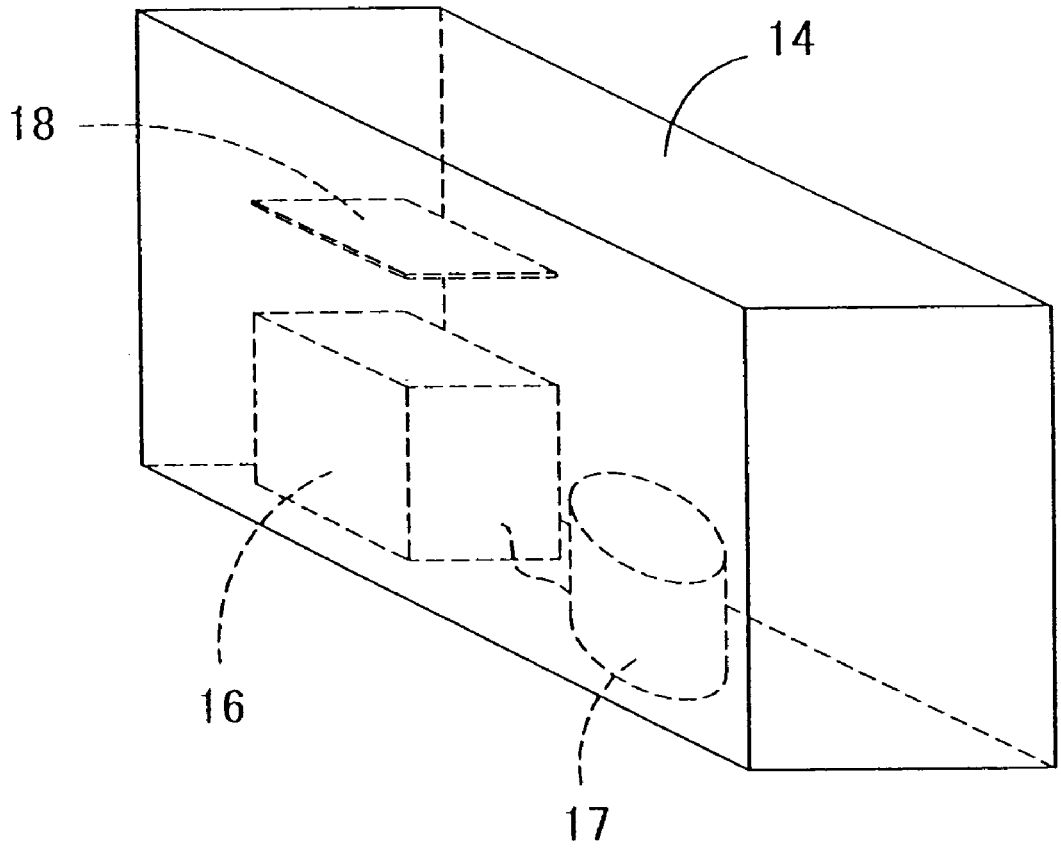
FIG. 8 is a schematic drawing that shows the structure of a comparison processing unit.

FIG. 8 is a schematic perspective view showing the structure of the comparison processing unit 14 that performs the image processing of circular images and comparison/determination thereof. The comparison processing unit 14 is made up of a processor 16, such as a personal computer, a CPU, or an MPU, a readable recording medium 17, such as a hard disk or a ROM, and an electronic circuit 18 comprising a circuit board or an IC chip. A coin discriminating program is recorded on the recording medium 17, and the functions of the A/D conversion means 141, the transformation processing means 142, the alignment means 143, the comparison means 144, the judgment means 145, etc., are performed by actuating the processor 16 in accordance with the coin discriminating program recorded on the recording medium 17. The A/D conversion means 141, etc., may be formed with the electronic circuit 18.

Figure 9:
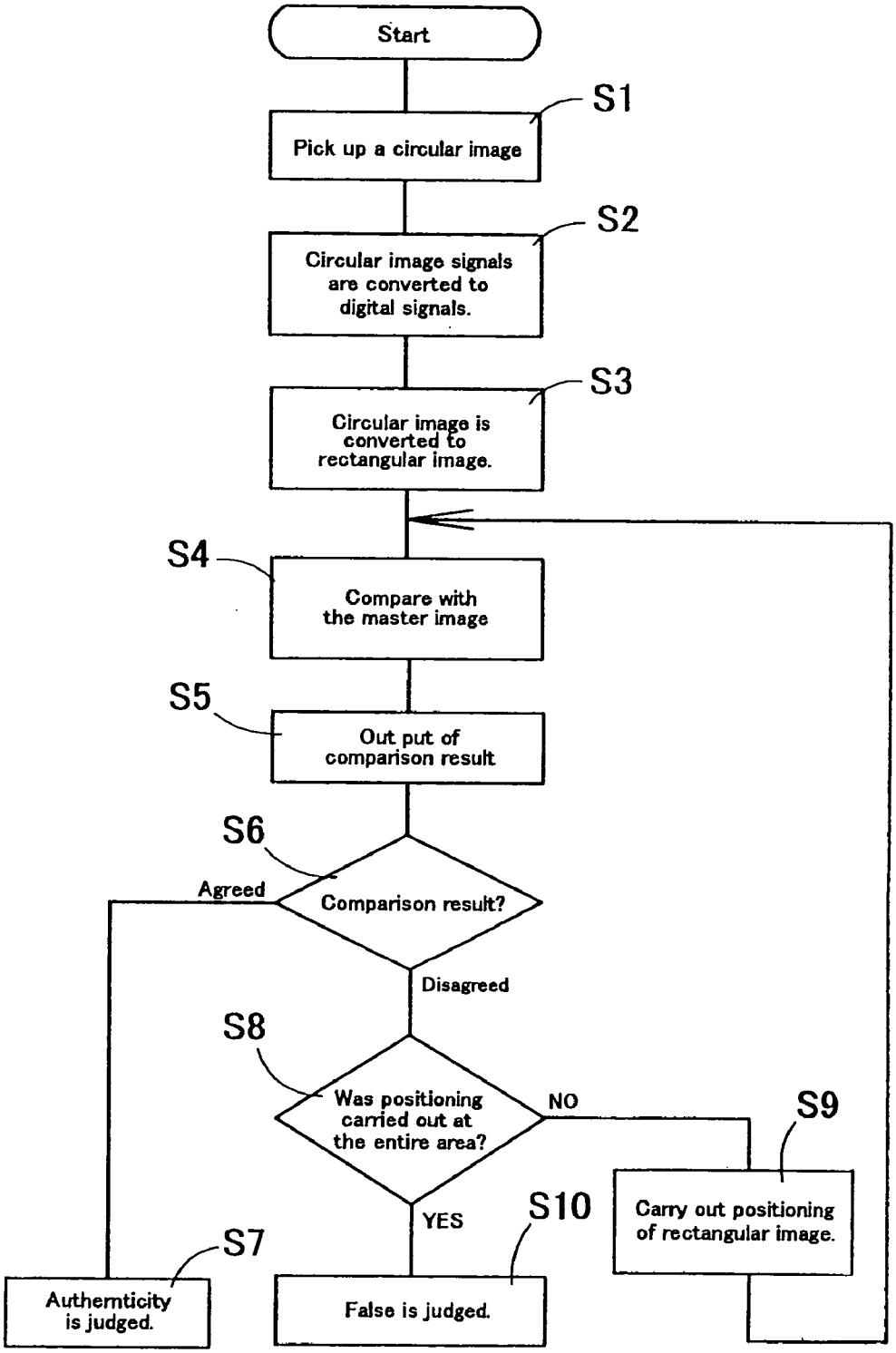
FIG. 9 is a flow chart that shows the structure of a coin discriminating program recorded on a recording medium included in the comparison processing unit.

FIG. 9 is a flowchart that shows one example of the processing algorithm of the coin discriminating program recorded on the recording medium 17. In this coin judging program, when a circular image of the coin photographed by the image pickup device is taken in (step S1), an analog circular-image signal thereof is converted into a digital signal (step S2). Thereafter, the circular image is transformed into a rectangular image according to the principle described in (a) and (b) of FIG. 4 (step S3), a rectangular image of the master coin is then read from the master-image memory 148, a comparison is then made between the image of the to-be-examined coin transformed into a rectangular image and the rectangular image of the master coin (step S4), and a comparison result is output (step S5). If this comparison result shows that the rectangular image of the to-be-examined coin and the rectangular image of the master coin coincide with each other (if they coincide in step S6), the to-be-examined coin appearing on the image is regarded as a genuine coin.

In contrast, if an obtained comparison result shows that the rectangular image of the to-be-examined coin and the rectangular image of the master coin do not coincide with each other (if they do not coincide in step S6), a pixel array at an edge of the rectangular image of the to-be-examined coin is moved to an opposite edge thereof so as to generate a new rectangle image (i.e., the rectangular image is aligned) (S9). Thereafter, a comparison is again made between the new rectangular image of the to-be-examined coin that has been aligned and the rectangular image of the master coin (step S4), and a comparison result is output (step S5).

The alignment of the rectangular image and a comparison with the image of the master coin are repeatedly performed until a comparison result shows that the coin is a genuine coin from a coincidence therebetween. If the rectangular image of the to-be-examined coin does not coincide with the master image in spite of the fact that the rectangle image has been aligned in the entire area of the rectangular image (if YES in step S8), the final decision that the to-be-examined coin is a spurious coin is formed.

SECOND EMBODIMENT

Although a determination is made as to whether a to-be-examined coin is genuine or spurious by comparing a to-be-examined rectangular image with a master rectangular image according to the aforementioned analysis program, discrimination between genuine and spurious coins can be made at higher processing speed by employing a histogram comparison method, a low-gradation histogram comparison method, or an isolation-number comparison method by characteristics of an image for comparison processing between the to-be-examined rectangular image and the master rectangular image.

Figure 10:
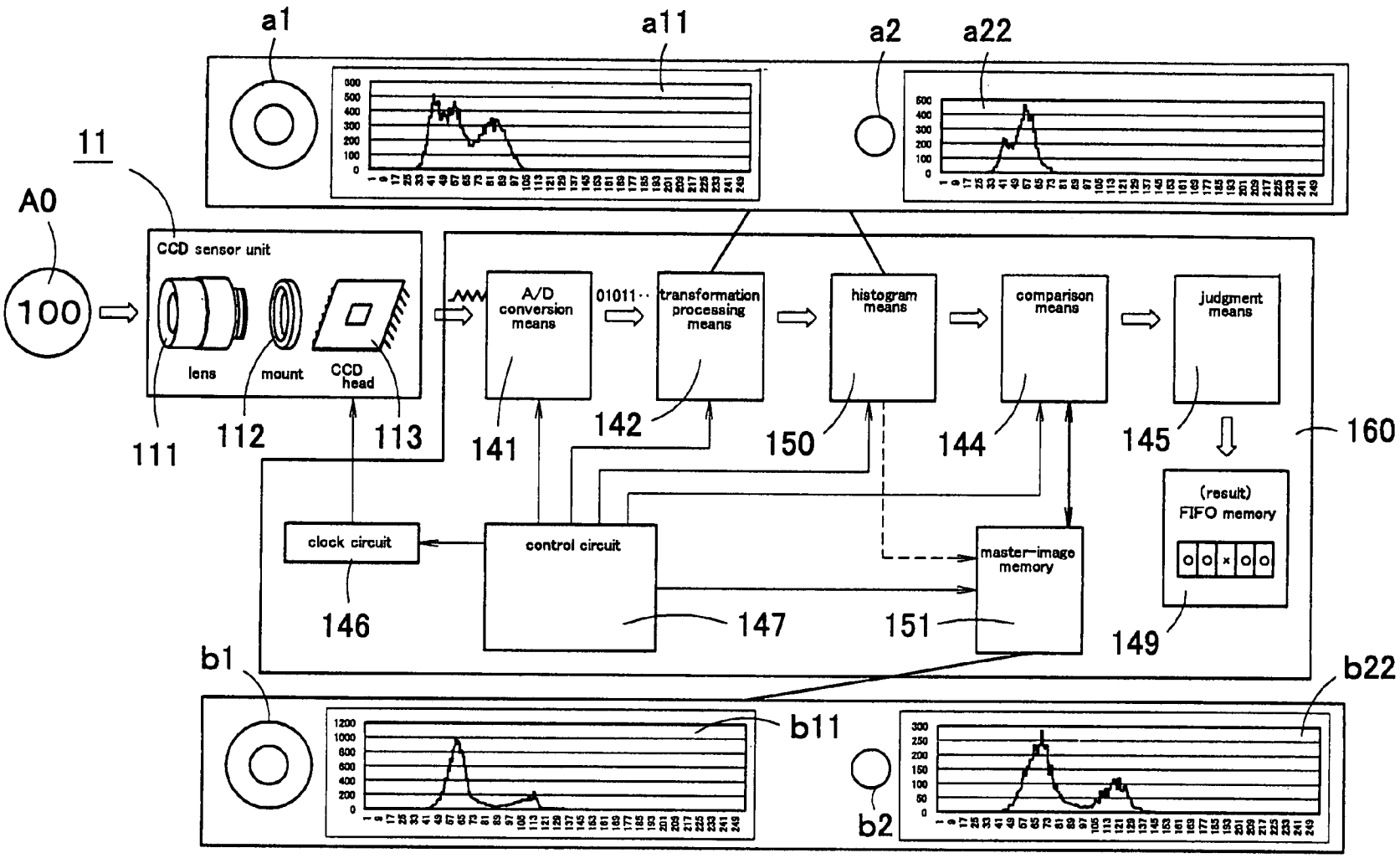
FIG. 10 is a block diagram that shows an electric structure of a coin discriminating apparatus according to a second embodiment of the present invention.

FIG. 10 is a block diagram that shows an electric structure of the coin discriminating apparatus that employs the histogram comparison method according to a second embodiment of the present invention. The histogram comparison method is a method for acquiring the brightness gradation data of, for example, 256 gradations in brightness regarding a to-be-examined coin image changed into a histogram form and judging genuineness or spuriousness by an adaptation degree through comparison processing between this brightness gradation data and brightness gradation data regarding a master image. In the coin discriminating apparatus shown in FIG. 10 the CCD sensor unit 11 is made up of the CCD head 113 that receives imaging light and converts it into an image signal, the lens 111 for forming an image of the to-be-examined coin A0 on the CCD head 113, and the mount 112 on which the lens 111 is detachably attached.

The comparison processing unit 160 includes the A/D conversion means 141 for converting an analog image signal indicating the coin A0 from the CCD sensor unit 11 into a digital image signal, the transformation processing means 142 for transforming a digital circular-image signal from the A/D conversion means 141 into a digital rectangular-image signal, a histogram means 150 for representing the digital rectangle-image signal transformed by the transformation processing means 142 as a histogram, the comparison means 144 for making a comparison between brightness gradation data represented as this histogram and histogram represented master brightness gradation data regarding a master image stored in a master-image memory 151, the judgment means 145 for judging a comparison result obtained from the comparison means 144, and the memory 149 for storing the judgment result.

The comparison processing unit 160 includes the control circuit 147 that controls the A/D conversion means 141, the transformation processing means 142, the histogram means 150, the comparison means 144, the judgment means 145, the memory 149, and a master-image memory 151, and the clock circuit 146 that is controlled by the control circuit 147 and gives a clock signal to the CCD head 113.

This coin discriminating apparatus employs the histogram comparison method. The principle of the histogram comparison method will be described here. In this embodiment, a circular image is divided into a plurality of images and transformed into rectangular images. Each of the rectangular images is represented as a histogram. For example, in FIG. 10, a circular image of the to-be-examined coin A0 is divided into two images a1 and a2. The outer doughnut-shaped circular image a1 is transformed into rectangular images, and then changed into brightness gradation data represented as a histogram designated as a11, whereas the inner small circular image a2 is transformed into rectangular images, and then changed into brightness gradation data represented as a histogram designated as a22. Likewise, a circular image of the master coin is divided into two images b1 and b2. The outer doughnut-shaped circular image b1 of the master coin is transformed into rectangular images, and then changed into master brightness gradation data represented as a histogram designated as b11, whereas the inner small circular image b2 of the master coin is transformed into rectangular images, and then changed into master gradation data represented as a histogram designated as b22. According to this histogram comparison method, the brightness gradation data in which the rectangular images of the master coin are represented as a histogram are prestored (registered) as master brightness gradation data b11 and b22 in the master-image memory 151. Therefore, in this coin discriminating apparatus, a determination can be made as to whether the to-be-examined coin A0 is genuine or spurious by dividing the image of the to-be-examined coin A0 into a plurality of images and making a comparison between the brightness gradation data a11 and a22 regarding the rectangular images transformed from the divided images and the corresponding master brightness gradation data b11 and b22.

Referring now to FIG. 10, a description will be given of the operation of the coin discriminating apparatus in the second embodiment. The operation performed until the CCD sensor unit 11 picks up the image of the to-be-examined coin has been described in the first embodiment, and therefore a description thereof is omitted here.

In the comparison processing unit 160, an image of the to-be-examined coin A0 is taken in, the process then proceeds to an image analysis mode, and an analysis program is executed. The analysis program has the functions of the A/D conversion means 141, the transformation processing means 142, the histogram means 150, the comparison means 144, and the judgment means 145.

The processing of the analysis program will be described here. An analog circular image signal output from the CCD sensor unit 11 is input to the A/D conversion means 141, is then converted into a digital circular-image signal, and is output. The digital circular-image signal output from the A/D conversion means 141 is input to the transformation processing means 142, and is divided into a plurality of image, areas. Thereafter, they are transformed into rectangular-image signals, respectively, and are represented as a histogram by the histogram means 150 so as to be, for example, brightness gradation data of 256 gradations in brightness (to-be-examined brightness gradation data) a11 and a22. The to-be-examined brightness gradation data represented as the histogram are compared with the master brightness gradation data b11 and b22, respectively, which have been read from the master-image memory 151, by the comparison means 144. A comparison result obtained thereby is input to the judgment means 145. Based on a comparison result that has been input, the judgment means 145 judges whether the inserted coin A0 is genuine or spurious, and a judgment result obtained thereby is stored in the memory 149. Thus, a determination is made as to whether the coins A0 successively inserted are genuine or spurious through the same processing procedure.

In the second embodiment, since a comparison is made between the brightness gradation data in which the rectangular image of the to-be-examined coin A0 is represented as a histogram and the brightness gradation data in which the master image (rectangular image) is represented as a histogram, and, based on this, a determination is made as to whether the to-be-examined coin is genuine or spurious, the alignment means is not needed unlike the first embodiment, and discrimination between genuine and spurious coins can be made at even higher processing speed. Additionally, since an image is divided into two areas, and histograms of the areas are compared with each other, judgment accuracy can be improved.

THIRD EMBODIMENT

Figure 11:
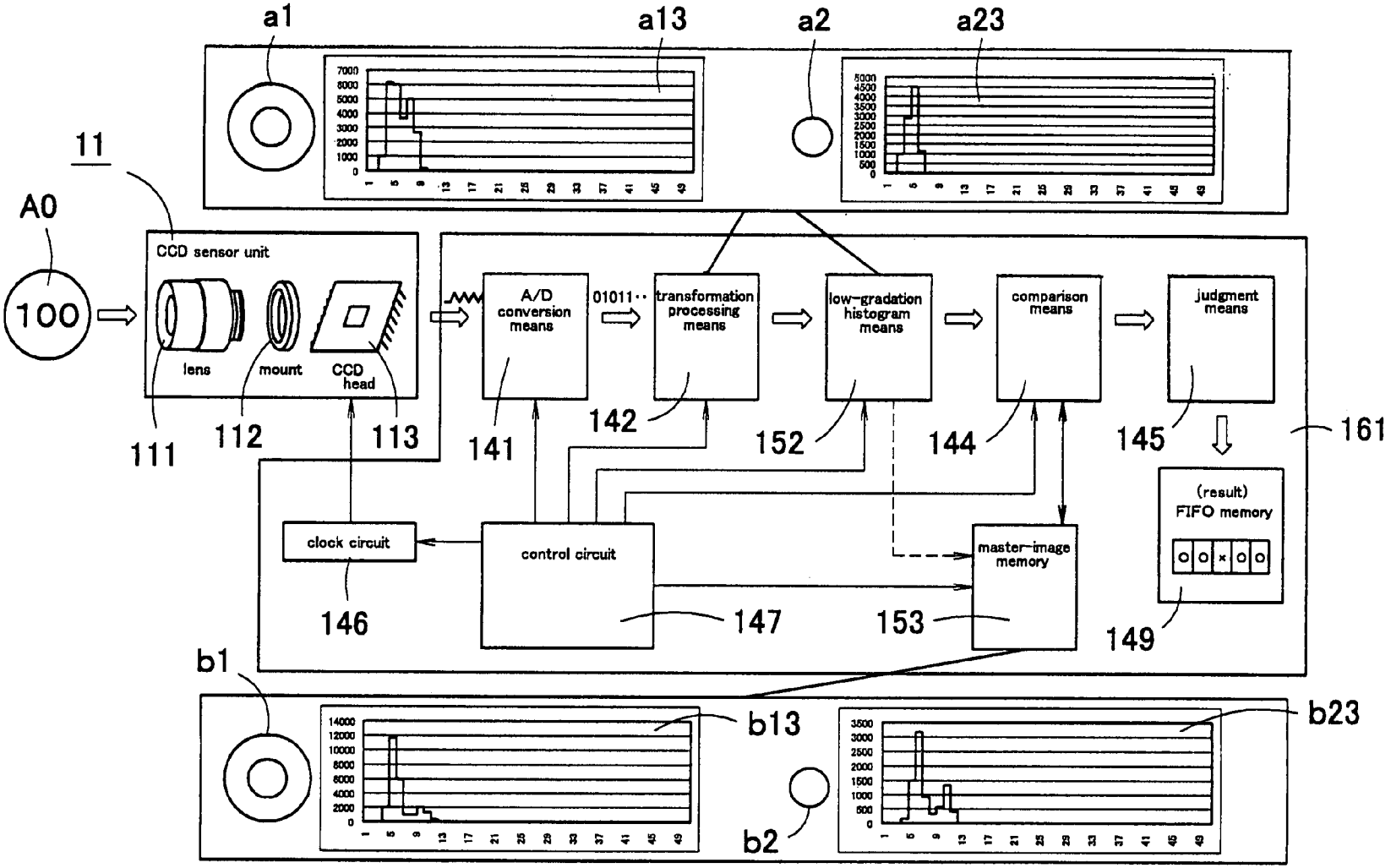
FIG. 11 is a block diagram that shows an electric structure of a coin discriminating apparatus according to a third embodiment of the present invention.

FIG. 11 is a block diagram showing an electric structure of, the coin discriminating apparatus that employs the low-gradation histogram comparison method according to a third embodiment of the present invention. In FIG. 11, the same reference symbols are given to constituent elements corresponding to those of FIG. 10, and a description thereof is omitted.

The low-gradation histogram comparison method is employed in the coin discriminating apparatus according to the third embodiment. The principle of the low-gradation histogram comparison method will be described here. In this embodiment, a circular image is divided into a plurality of images, they are then transformed into rectangular images, and each rectangular image is represented as a low-gradation histogram.

For example, in FIG. 11, a circular image of the to-be-examined coin A0 is divided into two images a1 and a2. The outer doughnut-shaped circular image a1 is transformed into rectangular images, and then changed into brightness gradation data represented as a low-gradation histogram designated as a13, whereas the inner small circular image a2 is transformed into rectangular images, and then changed into brightness gradation data represented as a low-gradation histogram designated as a23. Likewise, a circular image of the master coin is divided into two images b1 and b2. The outer doughnut-shaped circular image b1 of the master coin is transformed into rectangular images, and then changed into master brightness gradation data represented as a low-gradation histogram designated as b13, whereas the inner small circular image b2 of the master coin is transformed into rectangular images, and then changed into master brightness gradation data represented as a low-gradation histogram designated as b23. According to this histogram comparison method, the brightness gradation data in which the rectangular images of the master coin are represented as a low-gradation histogram are prestored (registered) as master brightness gradation data b13 and b23 in the master-image memory 151. Therefore, in this coin discriminating apparatus, a determination can be made as to whether the to-be-examined coin A0 is genuine or spurious by dividing the image of the to-be-examined coin A0 into a plurality of images and making a comparison between the brightness gradation data a13 and a23 regarding the rectangular images transformed from the divided images and the corresponding master brightness gradation data b13 and b23.

The coin discriminating apparatus that employs the low-gradation histogram comparison method is slightly inferior in discriminating accuracy to the coin discriminating apparatus that employs the histogram comparison method as mentioned in the second embodiment, but, since the comparison processing is simplified in the third embodiment, comparison processing speed is improved.

(Other Respects)

In each of the aforementioned embodiments, a description has been given of a case in which a judgment regarding whether the coin is genuine or spurious is formed only from the one side of the coin. However, if a determination has not yet been formed as to whether the to-be-examined coin is to be inserted while directing the obverse or reverse side of the coin upward, it is permissible to photograph both sides of the coin by the image pickup device, then select an image of the side to be examined, and compare this image with a master image stored in the master-image memory. Alternatively, it is permissible to store rectangular images, or the like, of both sides of the master coin stored in the master-image memory and compare the rectangular images of both sides of the coin photographed by the image pickup device with the master-image stored in the master-image memory.

In each embodiment, it is also permissible to store a plurality of rectangular images obtained by photographing at different angles with respect to the master coin used as a criterion in the master-image memory and allow the comparison means to make a comparison between the rectangular image of the to-be-examined coin and the plurality of rectangular images stored therein. In this case, discrimination accuracy regarding whether the to-be-examined coin is genuine or spurious is improved, or processing speed can be increased.

In each embodiment, it is also permissible to allow the comparison means to make a comparison between a rectangular image transformed by the transformation processing means and a rectangular image stored in the master-image memory based on the brightness of each pixel not based on the average brightness of each comparison area. In this case, the comparison accuracy of the difference of both the rectangular images is improved.

In each embodiment, it is also permissible to make a comparison between the rectangular image of the to-be-examined coin and the rectangular image of the master coin in image areas having high transformation accuracy from the circular image to the rectangular image. For example, in the first embodiment, an image part (e.g., part in the vicinity of the side 3 of FIG. 4, or fuzzy part in the vicinity of the lower side of FIG. 6. or FIG. 7) of the rectangular image corresponding to the center part of the circular image may be trimmed, and a comparison between images may be made only in an image area having high transformation accuracy from the circular image to the rectangular image. Accordingly, since the comparison between the rectangular image of the to-be-examined coin and the rectangular image of the master coin is made excluding the data of an area having low accuracy, the amount of data to be processed is reduced, and comparison processing speed can be improved without lowering the comparison accuracy.

In the embodiments described above, no specific limitations are imposed on the passing pattern of the coin A0 detected by the sensor bracket 10 in the coin passage path 15. That is, the coin A0 may be falling, rolling, or sliding in the coin passage path 15. Even if the coin is rotating or shaking, it is possible to normally send a correct image signal to the CCD sensor unit 11. No specific limitations are imposed on the kind of coin as well, and, especially, a perforated coin can be used. Likewise, the comparison processing unit 14 can perform processing regardless of the kind of image.

In order to register the master coin, it is possible to employ a method for analyzing and registering a first coin (method for setting a register mode and inserting a coin) or a method for grasping the features of a plurality of coins and registering them statistically. A user can easily select and change these registration methods, and any one of the registration methods makes it possible to accurately regard the coin as genuine or spurious one.

The coin discriminating apparatus and method of the present invention can be used to discriminate among coins in a vending machine or a ticket vending machine that performs predetermined processing procedures while using the coins, without being limited to the discrimination among coins used in a game machine, such as a slot machine, other game machines to play coin games, or a coin adjusting machine located in a game arcade.

INDUSTRIAL APPLICABILITY

According to the coin discriminating apparatus and the coin discriminating method of the present invention, a circular image of a to-be-examined coin taken by the image pickup device is transformed into a rectangular image, the rectangular image is then compared with a rectangular image stored in the rectangle-image storage means by the comparison means, and, if both of the rectangular images coincide with each other, the to-be-examined coin is regarded as a genuine coin, and, if both of them do not coincide with each other, the to-be-examined coin is regarded as a spurious coin or a counterfeit coin. According to the present invention, since the comparison therebetween is made by transforming the circular image of the coin into the rectangular image in this way, the circular image is not required to be rotated unlike the conventional method when the image of the to-be-examined coin is compared with the image of the master coin, and discrimination between genuine and spurious coins can be made swiftly through a simple processing procedure.

Therefore, use of counterfeit coins, such as coins used for other shops or spurious coins, can be accurately and swiftly discovered by providing this coin discriminating apparatus to a game machine, such as a slot machine, a coin adjusting machine, an automatic vending machine, or a ticket vending machine. Additionally, the reliability of coin discrimination can be improved.

The invention claimed is:

1. A coin discriminating apparatus for determining whether a to-be-examined coin is genuine or spurious by making a comparison between an image of the to-be-examined coin photographed by an image pickup device and a prestored image of a master coin used as a criterion, the coin discriminating apparatus comprising:

rectangular-image generation means for transforming a circular image of the to-be-examined coin photographed by the image pickup device into a rectangular image;

rectangular-image storage means for prestoring a rectangular image of a master coin used as a criterion, and comparison means for making a comparison between a rectangular image obtained by the rectangular-image generation means and the rectangular image stored in the rectangular-image storage means;

wherein the to-be-examined coin is determined to be genuine or spurious based on a comparison result obtained by the comparison means, wherein processing by the rectangular-image generation means, processing by the rectangular-image storage means, and processing by the comparison means are applied sequentially and in parallel to coins that have been inserted continuously or intermittently.

2. A coin discriminating method for discriminating between to-be-examined coins by making a comparison between an image of the to-be-examined coin taken by an image pickup device and a prestored image of a master coin used as a criterion wherein, a circular image of the to-be-examined coin photographed by the image pickup device is transformed into a rectangular image;

a comparison between the rectangular image and a prestored rectangular image of the master coin used as a criterion is made; and the to-be-examined coin is determined to be genuine or spurious based on a result obtained by the comparison, wherein a new rectangular image of the to-be-examined coin is generated by moving a partial image situated at an edge of the rectangular image to an opposite edge thereof in the rectangular image of the to-be-examined coin, and the new rectangular image of the to-be-examined coin is compared with the rectangular image of the master coin.

3. A coin discriminating apparatus for determining whether a to-be-examined coin is genuine or spurious by making a comparison between an image of the to-be-examined coin photographed by an image pickup device and a prestored image of a master coin used as a criterion, comprising:

rectangular-image generation means for transforming a circular image of the to-be-examined coin photographed by the image pickup device into a rectangular image;

rectangular-image storage means for prestoring data in which an image of the master coin used as a criterion is represented as a histogram; and a comparison means for making a comparison between histogram data regarding a rectangular image obtained by the rectangular-image generation means and histogram data stored in the rectangular-image storage means;

wherein the to-be-examined coin is determined to be genuine or spurious based on a comparison result obtained by the comparison means wherein processing by the rectangular-image generation means, processing by the rectangular-image storage means, and processing by the comparison means are applied sequentially and in parallel to coins that have been inserted continuously or intermittently.

* * * * *